US006599099B2

(12) United States Patent
Seo

(10) Patent No.: US 6,599,099 B2
(45) Date of Patent: Jul. 29, 2003

(54) HERMETIC RECIPROCATING PISTON COMPRESSOR

(75) Inventor: Seung-don Seo, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 0 days.

(21) Appl. No.: 10/106,611

(22) Filed: Mar. 26, 2002

(65) Prior Publication Data

US 2003/0035739 A1 Feb. 20, 2003

(30) Foreign Application Priority Data

Aug. 17, 2001 (KR) ..... 2001-49496

(51) Int. Cl.[7] ..... F04B 39/00
(52) U.S. Cl. ..... 417/312
(58) Field of Search ..... 417/312; 181/247, 181/248

(56) References Cited

U.S. PATENT DOCUMENTS 3,044,688 A * 7/1962 Frank et al. ..... 417/312
3,141,520 A * 7/1964 Kurtze ..... 181/247
3,202,344 A * 8/1965 Clausen ..... 417/312
4,401,418 A * 8/1983 Fritchman ..... 417/312
4,486,153 A * 12/1984 Romer et al. ..... 417/312
5,173,034 A * 12/1992 Riffe ..... 417/312
6,176,688 B1 * 1/2001 Collings et al. ..... 417/312
6,280,161 B1 * 8/2001 Seo ..... 417/312

* cited by examiner

*Primary Examiner*—Michael Koczo
(74) *Attorney, Agent, or Firm*—Ladas & Parry

(57) ABSTRACT

A hermetic reciprocating piston compressor capable of reducing vibration, noise, starting voltage, and power consumption, comprising a cylinder block; a cylinder head that is attached at the cylinder block and having a discharging chamber; a valve plate inserted between the cylinder block and the cylinder head: a first discharging muffler connected with the discharging chamber by a discharging passage disposed between the valve plate and the cylinder block; and a second discharging muffler connected to the first muffler at one end thereof by the connection pipe, and the discharging pipe being connected with another end the second discharging muffler, wherein the connection pipe has plural passages in a middle part thereof, and the passages merge to become one passage at both ends thereof.

5 Claims, 2 Drawing Sheets

HERMETIC RECIPROCATING PISTON COMPRESSOR

BACKGROUND OF THE INVENTION

1. Field of the Invention

The present invention relates generally to a hermetic reciprocating piston compressor, and more particularly to a hermetic reciprocating piston compressor having a reduced discharge pulse structure.

2. Description of the Related Art

A compressor having a conventional discharge pulse reduced structure is disclosed in Korean patent application No. 2001-11835, which is an unpublished prior application of the applicant.

The compressor having the above conventional discharge pulse reduced structure has the remarkable improvement of reducing vibration and noise. However, a problem exists in that the starting voltage and the power consumption are increased due to the passage resistance of the discharging part.

Moreover, if a different end of the discharge passage of the cylinder block is reduced and the diameter of the connection pipe and the discharge passage is broadened to improve the above-mentioned problem, then the starting voltage and the power consumption is reduced, however, this increases the problem of noise.

SUMMARY OF THE INVENTION

An object of the present invention is to solve the above-mentioned problem of conventional compressors, and to provide a hermetic reciprocating piston compressor having a discharge pulse reduced structure capable of reducing vibration, noise, starting voltage, and power consumption.

The above object is accomplished by providing a hermetic reciprocating piston compressor according to the present invention, comprising: a cylinder block; a cylinder head that is attached at the cylinder block and has a discharging chamber; a valve plate inserted between the cylinder block and the cylinder head: a first discharging muffler connected with the discharging chamber by a discharging passage disposed at the valve plate and the cylinder block; and a second discharging muffler, in fluid communication with the first muffler, and having a discharging pipe connected at one end thereof to the second discharging muffler, wherein the connection pipe comprises plural in a middle part thereof, with the plural passages becoming one passage at both ends thereof at the connections of the connecting pipe to the discharging mufflers.

It is preferable that the connection pipe is disposed so that the middle part thereof is immersed in cooling oil, that there be two passages in the middle of the connection pipe, and the ratio of the cross-sectional areas of the two passages of the connection pipe is 1:1.

Moreover, it is preferable that the inner diameters of both ends of the connection pipe are between approximately 1.5 and 4.0 mm, the inner diameters of the two passages in the middle part are between approximately 1.5 and 4.0 mm, the length of the connection pipe is between approximately 70 and 170 mm, and the volume of the first discharging muffler and the second discharging muffler is between approximately 25 and 50 cc.

DETAILED DESCRIPTION OF THE PREFERRED EMBODIMENT

The preferred embodiment of the present invention will be described in greater detail by referring to the appended drawings.

Figure 1:
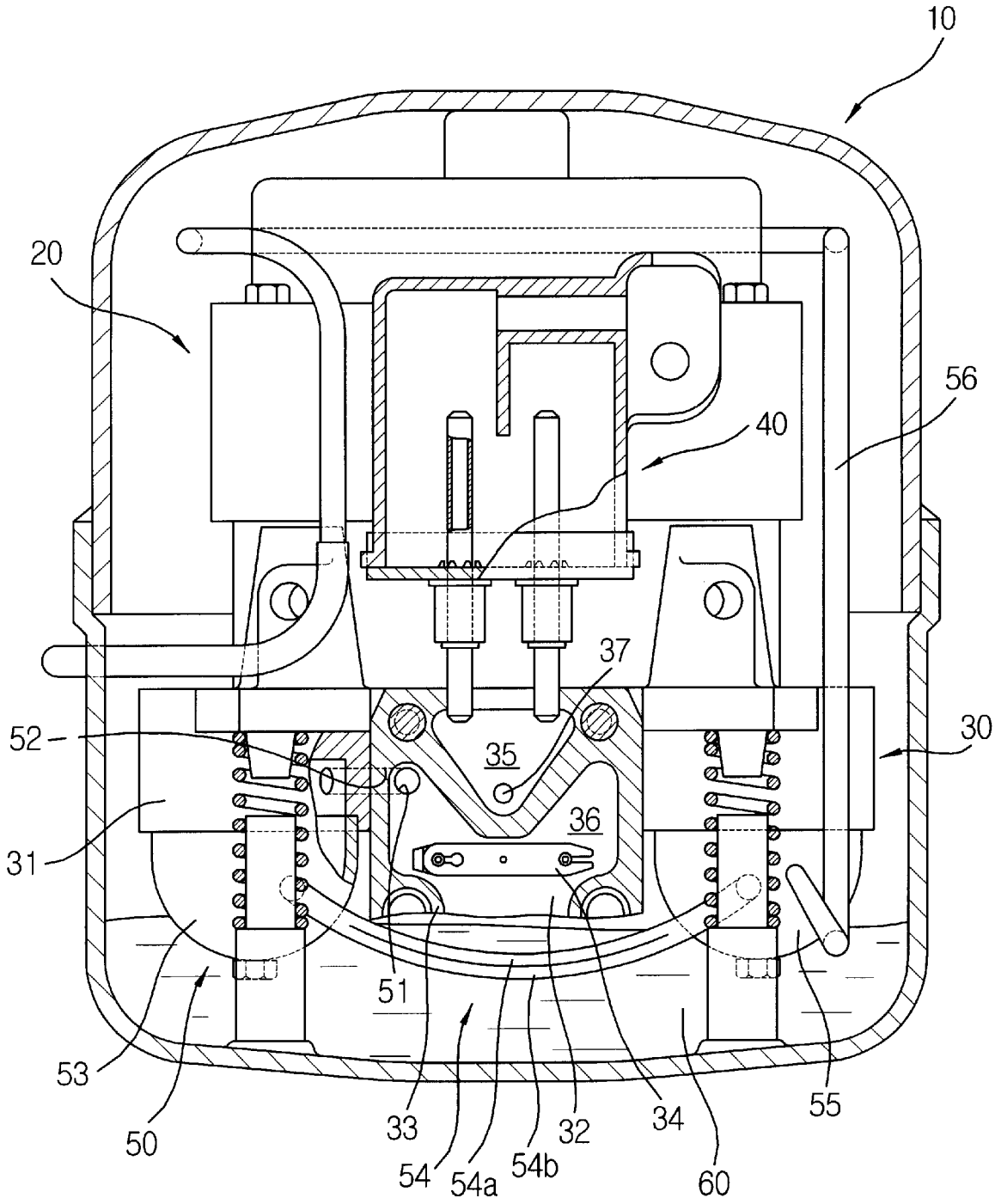
FIG. 1 is an elevational view in partial cross-section showing a hermetic reciprocating piston compressor according to the present invention.
Figure 2:
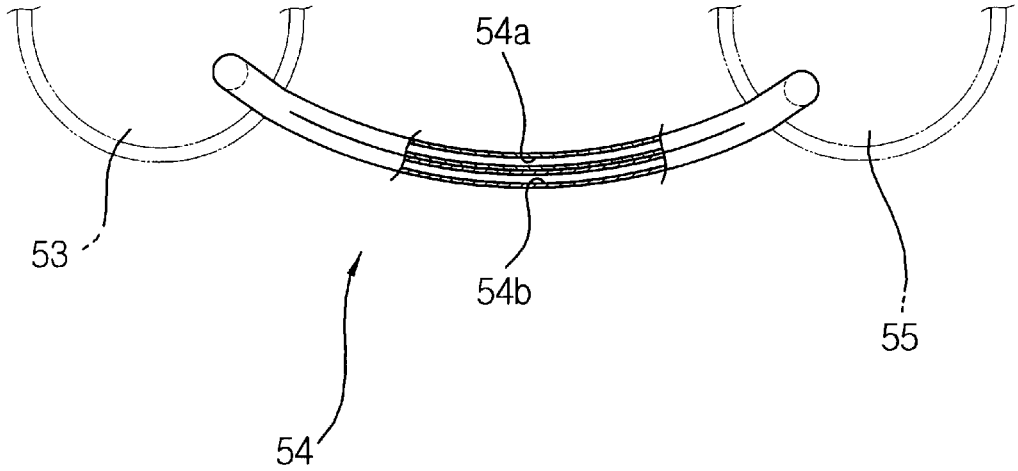
FIG. 2 is a detail view showing the structure of the connection pipe of the compressor of FIG. 1.

FIGS. 1 and 2 show one example of the hermetic reciprocating piston compressor according to the present invention. The compressor according to the present invention comprises: a case 10, an electronic components unit 20, a compressing unit 30, a suction muffler system 40, and a discharging muffler system 50.

The construction and the operation of the case 10, the electronic components unit 20, the compressing unit 30 and the suction muffler system 40 is generally the same as that of conventional hermetic reciprocating piston compressors, thus a detailed description of those components will be omitted.

In FIG. 1, reference numeral 31 is a cylinder block comprising the electronic components unit 20, and a cylinder bore (not shown) for accommodating a piston (not shown), used for drawing in a refrigerant and compressing the refrigerant. The cylinder block is shown horizontally extended from back to front in FIG. 1.

The cylinder block 31 is disposed in a flat relation at the front end of the cylinder bore. A gasket (not shown) is inserted between the valve plate 32 and the cylinder head 33 and is secured by appropriate means such as a bolt (not shown).

The suction valve (not shown) and the discharging valve 34 are secured at the valve plate 32 by a conventional method. The suction chamber 35 and the discharging chamber 36 are divided by the cylinder head 33, and the suction chamber 35 is connected with the cylinder bore through a suction port 37 and the suction valve (not shown).

The discharging muffler system 50 is disposed underneath of the cylinder block 31, and includes a pair of discharging mufflers 53 and 55 in fluid communication with each other by means of the connection pipe 54. It is preferable that at least the middle part of the connection pipe 54 be disposed so as to be immersed in cooling oil 60 (as shown).

The connection pipe 54 has two passages 54*a* and 54*b* in the middle part, and the two passages 54*a* and 54*b* join as one passage at both ends of the connection pipe 54. The discharging chamber 36 and the first muffler system 53 are connected by the discharging passage 52 of the cylinder block 31 and a discharging hole 51 of the valve plate 32.

In the meantime, by adjusting the length of the connection pipe 54 and the sectional area of the two passages 54*a* and 54*b* of the connection pipe 54, the vibration, noise, starting voltage and power consumption may be reduced.

In the hermetic reciprocating piston compressor having the above construction according the present invention, if the compressor operates, the compressing unit 30 is operated by the electric components unit 20, and thus a refrigerant gas compressed by the piston is discharged after passing through the discharging valve 34.

The refrigerant gas in the discharging chamber 36 is discharged to the discharging muffler 53 through the discharging hole 51 and the discharging passage 52. After that, the refrigerant gas is discharged to outside of the compressor through the discharging pipe 56 after being passed through the connection pipe 54 and the second discharging muffler 55.

At this time, the refrigerant gas passes through the first discharging muffler 53, a connection pipe 54 having two branched passages in the middle part thereof, and the second discharging muffler 55. The pulse of the refrigerant gas is thereby reduced. Accordingly, the vibration and the noise of the compressor are also reduced.

On the other hand, according to an experiment of the inventor of the present invention, it is revealed that when the inner diameter of both ends of the connection pipe 54, the inner diameter of the two passages 54*a* and 54*b* in the middle part of the connection pipe 54, the length of the connection pipe 54, and the volume of the discharging mufflers 53 and 55 is in the range that is described below, the vibration, noise, starting voltage, and the power consumption can each be reduced at the same time.

(A) the inner diameter of both ends of the connection pipe 54: 1.5 to 4.0 mm;

(B) the inner diameter of two passages 54*a* and 54*b* in the middle part of the connection pipe 54: 1.5 to 4.0 mm;

(C) the length of the connection pipe 54: 70 to 170 mm;

(D) the volume of the discharging mufflers 53 and 55: 25 to 50 cc.

Figure 3:
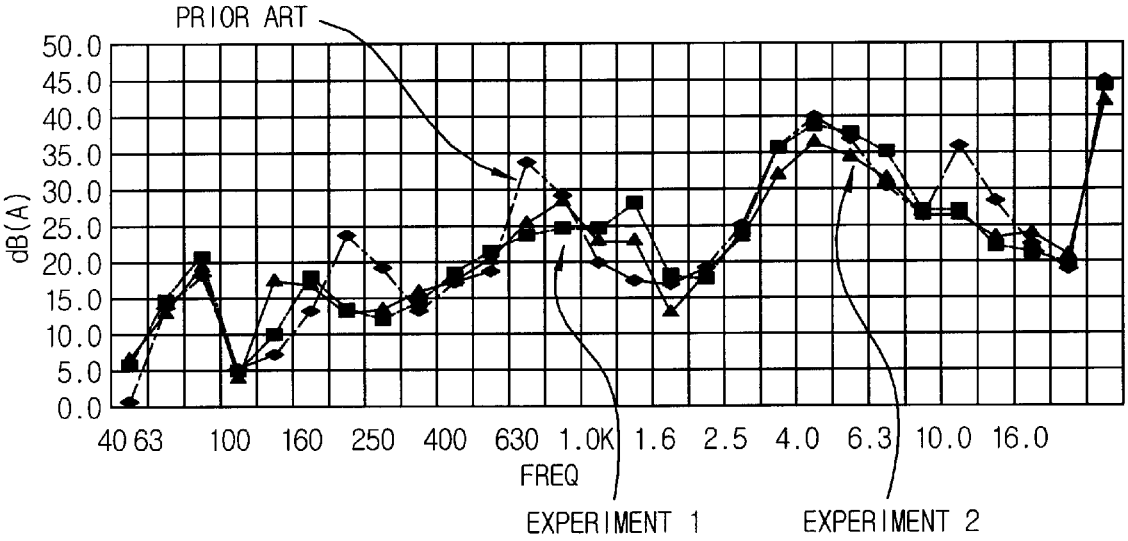
FIG. 3 is a graph showing the results of a comparison of the noise generated when driving a conventional compressor versus the compressor shown in FIG. 1.

Meanwhile, FIG. 3 is a graph showing results comparing the noise of a compressor having the above sizes and a conventional compressor having elements of conventional sizes.

As shown in the graph, in the compressor according to the present invention, the noise generated in the low frequency bandwidth under 1 kHz, indicative of resonance with other components of the cooling apparatus, has been reduced as compared to the noise generated in a conventional compressor.

Therefore, as described so far, in the hermetic reciprocating piston compressor according to the present invention, by adjusting the length of the connection pipe 54 and the sectional area of the two passages 54*a* and 54*b* in the middle part of the connection pipe 54, the vibration, noise, starting voltage and power consumption will be reduced.

So far, the preferred embodiment of the present invention has been illustrated and described. However, the present invention is not limited to the preferred embodiment described here, and someone skilled in the art can modify the present invention without distorting the point of the present invention claimed in the claim part.

What is claimed is:

1. A hermetic reciprocating piston compressor, comprising:

a cylinder block;

a cylinder head that is attached at the cylinder block having a discharging chamber;

a valve plate inserted between the cylinder block and the cylinder head:

a first discharging muffler connected with the discharging chamber by a discharging passage disposed between the valve plate and the cylinder block;

a second discharging muffler in fluid communication with the first muffler at one end thereof by a connection pipe, and having a discharging pipe connected at one end of the second discharging muffler; and said connection pipe disposed between and connecting the first discharging muffler and the second discharging muffler, wherein the connection pipe comprises plural passages in a middle portion thereof, the passages converging to a single passage at both ends of the connection pipe adjacent the connections to each of the discharge tubes.

2. The hermetic reciprocating piston compressor of claim 1, wherein the middle portion of the connection pipe is disposed immersed in cooling oil.

3. The hermetic reciprocating piston compressor of claim 1, wherein the middle portion of the connection pipe comprises two passages.

4. The hermetic reciprocating piston compressor of claim 3, wherein the ratio between the cross-sectional areas of the two passages of the middle portion of the connection pipe is 1:1.

5. The hermetic reciprocating piston compressor of claim 4, wherein the inner diameters of both ends of the connection pipe are between 1.5 and 4.0 mm, the inner diameters of the two passages in the middle part are between 1.5 and 4.0 mm, the length of the connection pipe is between 70 and 170 mm, and the volume of the first discharging muffler and the second discharging muffler is between 25 and 50 cc.

* * * * *